United States Patent [19]

Mochida et al.

[11] 4,305,056

[45] Dec. 8, 1981

[54] TRANSFORMER WITH GAPPED CORE

[75] Inventors: Hideyuki Mochida; Etsuo Tsurumi; Shingo Tamura, all of Yokohama; Noboru Mitsugi, Tokyo, all of Japan

[73] Assignee: Hitachi, Ltd., Tokyo, Japan

[21] Appl. No.: 98,663

[22] Filed: Nov. 29, 1979

[30] Foreign Application Priority Data

Nov. 29, 1978 [JP] Japan ..... 53/146497

[51] Int. Cl.[3] ..... H01F 17/06; H01F 41/02

[52] U.S. Cl. ..... 336/178; 29/606; 29/607; 336/219

[58] Field of Search ..... 336/178, 134, 219, 165, 336/216; 29/602 R, 605, 606, 607, 608, 609

[56] References Cited

U.S. PATENT DOCUMENTS

| | | | |
|---|---|---|---|
| 2,055,175 | 9/1936 | Franz | 336/219 X |
| 2,494,180 | 1/1950 | Koubek | 336/219 X |
| 2,674,721 | 4/1954 | Jackson et al. | 336/134 |
| 3,609,615 | 9/1971 | Parker | 336/219 X |

FOREIGN PATENT DOCUMENTS

| | | | |
|---|---|---|---|
| 1051627 | 1/1954 | France | 336/178 |
| 482275 | 1/1970 | Switzerland | 336/178 |
| 1418976 | 12/1975 | United Kingdom | 336/178 |
| 15106635 | 5/1978 | United Kingdom | 336/178 |

*Primary Examiner*—Thomas J. Kozma
*Attorney, Agent, or Firm*—Craig and Antonelli

[57] ABSTRACT

In a transformer for use in a receiver set, a non-magnetic material arranged in part of a closed magnetic path established by a magnetic core is made of a plastic material such as paper mash or silicon putty. The non-magnetic material is pressurized and deformed so as to set the inductance of a coil mounted on the magnetic core to a predetermined value.

4 Claims, 9 Drawing Figures

TRANSFORMER WITH GAPPED CORE

This invention relates to transformers and more particularly to a transformer wherein a closed magnetic path is established by a magnetic core and a non-magnetic material is arranged in part of the closed magnetic path to form a gap.

The prior art and the present invention, and advantages of the latter will be described with reference to the accompanying drawings in which:

FIG. 1 is a perspective view, partly cut away, of an example of transformers to which this invention is applicable;

FIGS. 2*a* and 2*b* are perspective views of nonmagnetic blocks used in a prior art transformer;

FIGS. 3*a* and 3*b* are front views to show configurations of a pair of magnetic members;

In a transformer (flyback transformer) used in a high voltage rectifier system of a television receiver set, for example, a closed magnetic path is established by a magnetic core, and primary and secondary coils are mounted on the core so that high-density magnetic flux is generated in the magnetic core. If the magnetic flux density in the core of a transformer is so high that magnetic flux becomes saturated even when the intensity of magnetic field created by primary coil current is small, the transformer cannot make full use of its capability. Accordingly, it is general practice to arrange a non-magnetic material in part of the closed magnetic path in order to prevent saturation of magnetic flux.

Figure 1:
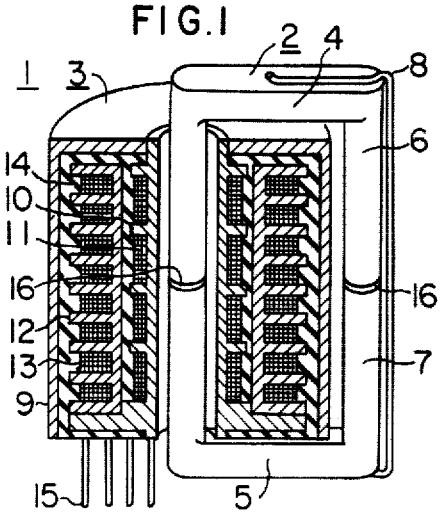

FIG. 1 shows a perspective view of a transformer to which the present invention is applicable, in which a coil block accomodating a primary and a secondary coil is partly cut away. The transformer 1 comprises a magnetic core 2 and a coil block 3 mounted on the magnetic core 2. The magnetic core 2 comprises a pair of U-shaped magnetic members 4 and 5 with their legs 6 and 7 facing each other, thus establishing an O-shaped closed magnetic path. The U-shaped magnetic members 4 and 5 are molded from ferrite or other suitable magnetic materials, and they are clamped by means of a U-shaped clip 8. The coil block 3 includes therein a primary coil 11 wound on a primary coil bobbin 10 arranged in a cylindrical coil casing 9, a secondary coil 13 wound on a secondary coil bobbin 12 arranged exteriorly of the primary coil bobbin 10, and an insulating resin 14 filling the interior of the coil casing 9. The primary and secondary coils 11 and 12 are connected to terminals 15 which are studded in the primary coil bobbin 10.

Figure 2A:
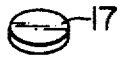
Figure 2B:
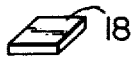

The magnetic core 2 of the transformer 1 comprised of the magnetic members 4 and 5 is provided with gaps 16 at abutting surfaces of the legs 6 and 7 of the magnetic members 4 and 5. In the prior art, these gaps 16 are provided by inserting between the abutting surfaces of the legs 6 and 7 circular blocks 17 of non-magnetic material as shown in FIG. 2*a* or rectangular non-magnetic blocks 18 as shown in FIG. 2*b*, which are previously formed with a predetermined thickness. The gaps formed by the disposition of the non-magnetic blocks 17 or 18 in the magnetic core 2 reduce the specific permeability of the magnetic core 2 as a whole, thereby suppressing the tendency to saturation of magnetic flux (magnetic flux density). In other words, magnetic flux created in the magnetic core 2 remains unsaturated until the intensity of magnetic field created by current passing through the primary coil 11 is maximized. However, the reduction in specific permeability accruing from the gaps 16, causes errors (irregularities) in the specific permeability when the thickness of the non-magnetic block 17 or 18 varies due to errors (irregularites) in manufacture, resulting in irregularity in the characteristic of a transformer such as inductances of the primary and secondary coils. A resin film or an adhesive tape is ordinarily used as the non-magnetic block 17 or 18. In general, the resin film has an irregularity of about $\pm 10\%$ in thickness. In the case of the adhesive tape, an irregularity in thickness of its base is added with an irregularity in thickness of its bonder with the result that the total irregularity is aggravated. Consequently, the irregularity in the inductances of the primary and secondary coils amounts to a considerable magnitude.

Figure 3A:
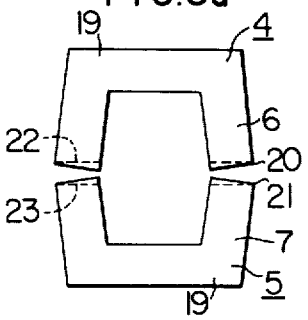
Figure 3B:
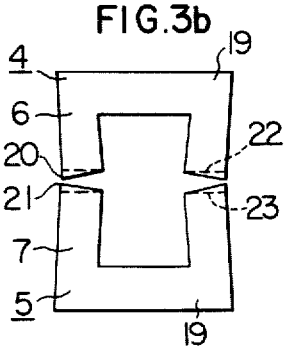

On the other hand, ferrite is typically used for the magnetic members 4 and 5. The dimensional accuracy of the magnetic members is extremely poor since magnetic powders are molded and then sintered (heated) at high temperatures to form the ferrite. When sintering, the ferrite will contract and in the event of irregular contraction, the legs 6 and 7 of the magnetic members 4 and 5 will warp relative to bridges 19 to be extended beyond or narrowed below the length of the bridges as shown in FIGS. 3*a* and 3*b*. As a result, the parallelism between abutting portions (surfaces) of the legs 6 and 7 of magnetic members 4 and 5 is disturbed and gaps are created even in the absence of the non-magnetic blocks 17 and 18. As described above, the magnetic members 4 and 5 made from ferrite suffer from poor dimensional accuracy and cannot be used unless worked suitably. Then, actually, the tip of the legs 6 and 7 is polished to shape the abutting portions 20 and 21 into parallel surfaces as shown at dashed lines 22 and 23. This working raises the manufacturing cost of the magnetic members 4 and 5 to a great extent.

Since a transformer as used in a high voltage rectifier system of a television receiver forms part of a resonance circuit which is tuned to a specified frequency and its higher harmonics as well known in the art, it is desired that the inductance of the coil be coincident with a predetermined value. Further, polishing the ferrite magnetic member requires a high cost as described above and hence it is desired to eliminate this operation from the manufacturing process.

This invention has for its general object to provide a transformer which can minimize the irregularity in the inductance of the coil and specifically, it is an object of this invention to provide a transformer which can minimize the irregularity in the inductance of the coil even with magnetic members disturbed in parallelism between abutting portions (surfaces) of their legs.

As the length of the gap varies, the inductance of the coil also varies. Accordingly, it is possible to determine the inductance of the coil to a suitable value by desirably changing the thickness of the non-magnetic block. In particular, if the thickness of the non-magnetic block is changed while measuring the inductance of the coil and changing the thickness of the non-magnetic block is halted at a desired value of the inductance of the coil, the transformer can be incorporated with the coil of the desired inductance.

In the transformer according to the invention, the non-magnetic block is made of plastically deformable material. Since the material for the non-magnetic block is easy to deform, the thickness of the non-magnetic block can be varied by imparting force or pressure on the pair of magnetic members in opposite directions. In the course of varying the thickness of the non-magnetic block, the inductance of the coil is measured. When the inductance of the coil reaches a predetermined, suitable value, the force imparted on the magnetic members is removed to thereby prevent the thickness of the non-magnetic block from being varied. Under this ultimate state, the pair of magnetic members are clamped. While the magnetic members are imparted with force or pressure in the opposite directions, simultaneous vibration to cause to-and-fro rubbing, for example, of the legs of the magnetic members is preferably applied to the magnetic members so that the non-magnetic block can readily be deformed even with small force imparted in the opposite directions. In this manner, according to an embodiment of the invention, the magnetic members are pressurized under simultaneous application of vibration.

The invention will now be described by way of preferred embodiments thereof.

Figure 4:
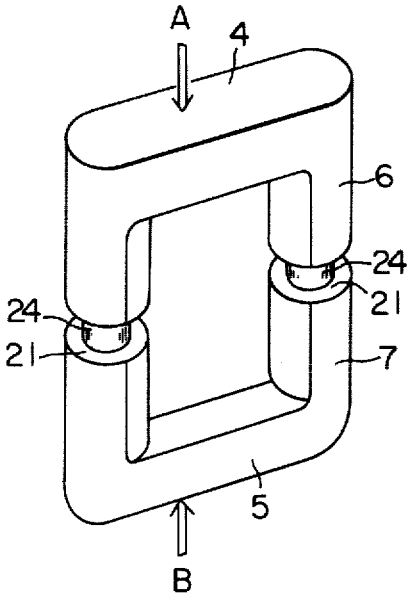
FIG. 4 is a perspective view to show the main part of a transformer according to the invention.

In a transformer according to an embodiment of the invention shown in the perspective form in FIG. 4, a suitable amount of non-magnetic material 24 is sandwiched between abutting surfaces 21 of legs 6 and 7 of a pair of magnetic members 4 and 5, and the magnetic members 4 and 5 are oppositely pressed in directions as shown by arrows A and B. For brevity, a coil block is not illustrated in FIG. 4.

Used as the non-magnetic material 24 is so-called paper mash or paper clay in which paper fibers and plaster powders are kneaded together with water. The paper mash is the most preferable. Viscosity of the paper mash is sensitive to the amount of water added and is easy to adjust. The paper mash is immune from static force applied thereto and is hardly deformable, but it can readily be deformed by a vibratory motion to grind down the paper mash, which is applied thereto in addition to the static force. Once deformed, the paper mash remains almost unchanged in its shape after removal of the force. Specifically, 2 Kgf pressure is sufficient to deform the paper mash under application of vibration, whereas 20 to 400 Kgf pressure is necessary to deform the paper mash in absence of vibration. By virtue of the fact that the paper mash is immune from static force for its deformation, once deformed, the paper mash is kept highly resistive to deformation even if external force is applied by accident to the magnetic member 4 or 5, for example.

Figure 5:
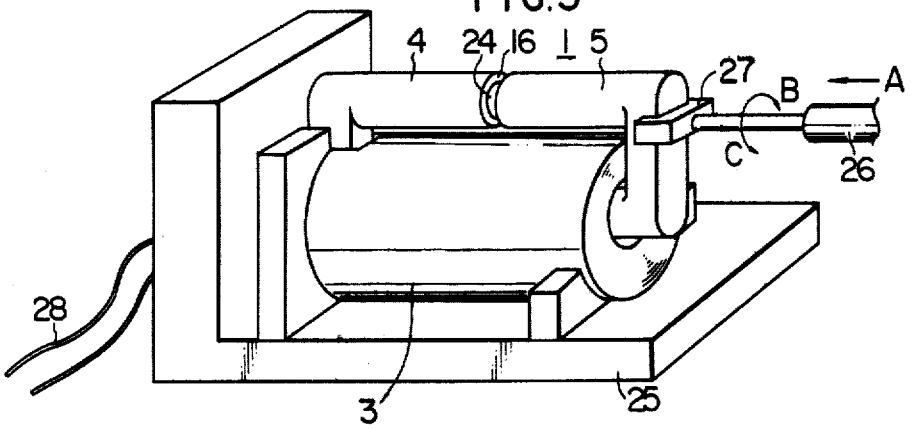
FIG. 5 is a perspective view to show the main part of an arrangement for pressurizing and deforming a non-magnetic block used in the transformer according to an embodiment of the invention.

The non-magnetic material can be deformed by means of an arrangement as shown in FIG. 5. The transformer 1 is fixedly mounted on a base 25 of the arrangement, and the inductance of the primary coil 11 is measured with a measuring unit connected to lead wires 28. The magnetic member 5 is supplied with force by pushing a press rod 26 in a direction of arrow A. Secured to the fore end of the press rod 26 is a U-shaped adaptor 27 with which the magnetic member 5 is mated. The press rod 26 is coupled with a pneumatic cylinder, whereby the magnetic member 5 can be pushed in the direction of arrow A and at the same time turned alternately in directions of arrows B and C. As a result of alternate vibration in arrow B and C directions of the press rod 26 and transmission of force in arrow A direction to the non-magnetic material 24 via the magnetic member 5, the paper mash 24 can be deformed. The deformation of paper mash 24 leads to variation in length of gap 16 and consequent variation in inductance of the coil 11.

Figure 6:
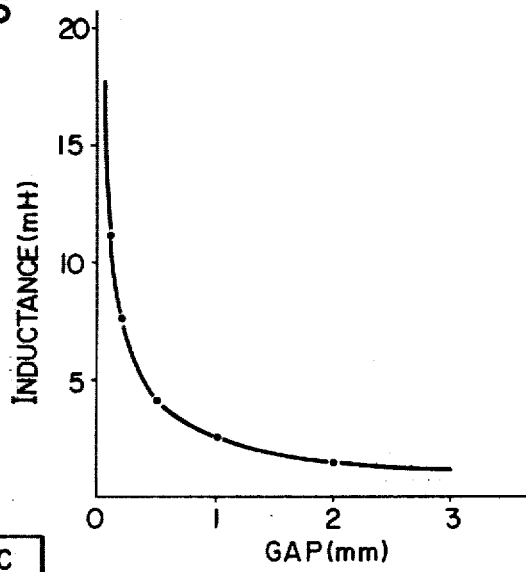
FIG. 6 is a graph to show the relation between inductance of a coil and the length of a gap.

Shown in FIG. 6 is a graph to show the variation in inductance of the primary coil of a transformer used in a high voltage rectifier system of a television receiver set, where the abscissa represents the gap length and the ordinate the inductance. As will be seen from FIG. 6, the more the length of gap 16 increases, the smaller the inductance becomes. As the non-magnetic material 24 is pressurized and deformed to gradually reduce the length of the gap 16, the inductance of the coil 11 increases gradually. Accordingly, when it is desired that the inductance of the coil be set to 2.5 mH, the initial length of gap 16 should be more than 1 mm and a paper mash of the order of thickness of 2 mm, for example, is used as non-magnetic material 24. With a paper mash of less than 1 mm thickness being used as non-magnetic material, it is impossible to set the inductance of the coil to 2.5 mH. It is to be noted that the secondary coil inductance depends substantially on its positional relation to the primary coil and changes in substantially proportional relationship with the primary coil inductance. Therefore, provided that the mutual position is correct, when the primary coil inductance is adjusted to a predetermined value, the secondary coil inductance can be approximated to a predetermined value.

Figure 7:
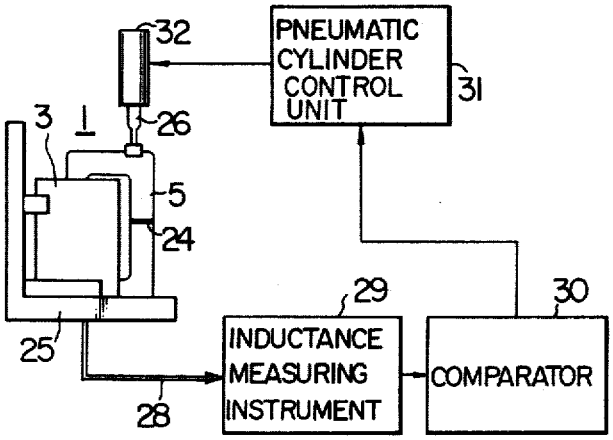
FIG. 7 is a block diagram of a system for adjusting the transformer according to an embodiment of the invention.

FIG. 7 shows in the block form a system for adjusting the transformer in accordance with an embodiment of the present invention. As described above, the transformer 1 is fixedly mounted on the base 25, and the magnetic member 5 is pushed and vibrated by means of the press rod 26 to deform the non-magnetic material 24. In this procedure, the inductance of the coil in the coil block 3, for example, of the primary coil electrically connected to lead wires 28 is measured with an inductance measuring instrument 29. The inductance measuring instrument 29 detects the magnitude of inductance and delivers out voltage signals, for example, which are representative of variation in the inductance. A commercially available LCR meter which is adapted to measurement of inductance L of coils, capacitance C of capacitors and reistance R of resistors may be used as the instrument 29. The output voltage of the inductance measuring instrument 29 is supplied to a comparator 30. The comparator 30 compares the magnitude of the voltage from the inductance measuring instrument 29 with a predetermined reference voltage, whereby when the output voltage of the instrument 29 is below the reference voltage, no output signal is delivered out of the comparator 30 but when that output voltage reaches the reference voltage, the comparator 30 produces an output signal which in turn is supplied to a pneumatic cylinder control unit 31. The magnitude of the reference voltage of course corresponds to the preset value of inductance. When receiving the output signal of the comparator 30, the pneumatic cylinder control unit 31 produces an output signal for stopping the operation of pneumatic cylinder 32. The pneumatic cylinder 32 stops its operation to cease further application of pressure on the magnetic member 5. By this, the non-magnetic material 24 stops deforming. As a result, the primary coil inductance can be set to the desired value. Thereafter, the transformer 1 is dismounted from the base 25 and the magnetic members 4 and 5 are clamped by means of a U-shaped clip such as conventionally used. Obviously, the U-shaped clip should not be put on the magnetic members with so large a clamping force as to deform the non-magnetic material 24, but the clamping force of the U-shaped clip should be slightly smaller than the force transmitted to the magnetic members 4 and 5 from the press rod.

As described above, in the transformer of this invention, since the gap length can be varied so as to adjust the inductance of the transformer coil to the predetermined value, the irregularity in the coil inductance can be minimized. Obviously, even with the ferrite magnetic member whose leg is not polished at its fore end, it is possible to adjust the coil inductance to the predetermined value. A number of prior art transformers and transformers of this invention, used in a high voltage rectifier system of a television receiver set, were examined on their irregularity in the coil inductance, where the prior art transformers had the magnetic members whose legs were polished at its fore ends and the transformers of this invention had unpolished magnetic members. The non-magnetic block of the prior art transformer was a film of synthetic resin whereas the non-magnetic material of the transformer of this invention was paper mash. Results were:

Irregularity in inductance of the prior art transformer—3.3%

Irregularity in inductance of the transformer of this invention—3.0%

The above values are for so-called $3\sigma$. As will be seen from the above, the irregularity in the coil inductance of the transformer of this invention, even though the magnetic member is unpolished, is smaller than that of the prior art transformer. It will be appreciated that the unpolished magnetic member has a larger irregularity in permeability than that of the polished magnetic member by about $\pm 5\%$. Thus, it should be understood that even when the unpolished magnetic member subject to large irregularity in permeability, the transformer of this invention can minimize the irregularity in inductance. Needless to say, with the polished magnetic member, the transformer of this invention can further minimize the irregularity in inductance.

Although two non-magnetic materials are provided at the right and left abutting joints of the magnetic members in the embodiment of FIG. 4, one non-magnetic material may be arranged at one abutting joint and may be pressurized and deformed so as to adjust the coil inductance. In this modification, a non-magnetic block as in the prior art transformer may be arranged at the other abutting joint or alternatively no non-magnetic material or block may be provided thereat.

As described above, according to the invention, the non-magnetic material to be arranged in part of closed magnetic path of the magnetic core of the transformer is made of paper mash, and the paper mash is pressurized and deformed so as to set the coil inductance to the predetermined value, thereby minimizing the irregularity in the coil inductance. Moreover, in the transformer of this invention, it is possible to vary the gap length by pressurizing and deforming the non-magnetic material to thereby ensure that the magnetic member of the magnetic core can be used which has unpolished abutting surface on the leg, and even with the unpolished magnetic member, the irregularity in the coil inductance can be minimized.

What is claimed is:

1. A transformer comprising:

a magnetic core including two U-shaped magnetic members with their legs faced with each other to establish a closed magnetic path;

a non-magnetic material arranged at least at one joint between facing legs of the magnetic members constituting the magnetic core and being a compound of paper fibers and plaster powders so as to be deformable by a force imparted on the magnetic members;

a plurality of coils mounted on said magnetic core and being adjustable in inductance by the deformation of said non-magnetic material; and means for clamping said magnetic core with said deformed non-magnetic material in said joint to provide desired inductances of the coils with a clamping force which is not so large as to further deform said non-magnetic material.

2. A transformer comprising:

a magnetic core including two U-shaped magnetic members with their legs facing each other in axial alignment to establish a closed magnetic path;

a spacer of non-magnetic material arranged at least at one joint between the magnetic members, said non-magnetic material being formed of paper fibers and plaster powder which are kneaded together with water, and said spacer being deformed by pressure and vibration of the magnetic members with respect to each other in a back and forth rubbing action at the joint, so that said pressure and vibration are imparted to said non-magnetic material by means of the magnetic members;

a plurality of coils mounted on said magnetic core and being varied in inductance with the deformation of said non-magnetic material; and means for clamping said magnetic core to produce pressure on said deformed non-magnetic material in said joint in the axial direction of said keys, thereby providing said coils with the desired inductances.

3. A method of making a transformer having a magnetic core with at least one joint filled with a non-magnetic material, comprising the steps of placing two U-shaped magnetic members with their legs facing each other in axial alignment to establish a closed magnetic path;

disposing a spacer of non-magnetic material in at least one joint between the magnetic members, said non-magnetic material being formed of paper fibers and plaster powder which are kneaded together with water; and applying pressure to said spacer along the legs of said magnetic members while vibrating said magnetic members with a back and forth rubbing action at least at said one joint to deform said spacer.

4. A method as claimed in claim 3, including the further steps of mounting at least one coil on said magnetic core;

measuring the inductance of said coil while said spacer is being deformed;

ceasing the vibration of said magnetic members when the inductance of said coil reaches a desired value; and clamping said magnetic core to provide a clamping force on said spacer which is not so large as to further deform said non-magnetic material.

* * * * *